US012605758B2

(12) United States Patent
Wang et al.

(10) Patent No.: US 12,605,758 B2
(45) Date of Patent: Apr. 21, 2026

(54) MULTI-STATION NECK FORMING EQUIPMENT FOR RING-PULL CANS

(71) Applicant: SUZHOU SLAC PRECISION EQUIPMENT CO., LTD, Suzhou (CN)

(72) Inventors: Bingsheng Wang, Suzhou (CN); Yunhua Niu, Suzhou (CN); Tianqi Wu, Suzhou (CN); Lingguang Kong, Suzhou (CN); Yang Wang, Suzhou (CN)

(73) Assignee: SUZHOU SLAC PRECISION EQUIPMENT CO., LTD, Suzhou (CN)

( * ) Notice: Subject to any disclaimer, the term of this patent is extended or adjusted under 35 U.S.C. 154(b) by 643 days.

(21) Appl. No.: 17/942,791

(22) Filed: Sep. 12, 2022

(65) Prior Publication Data

US 2023/0084741 A1 Mar. 16, 2023

(30) Foreign Application Priority Data

Sep. 10, 2021 (CN) ..... 202111059794.5

(51) Int. Cl.
*B21D 51/26* (2006.01)

(52) U.S. Cl.
CPC ..... *B21D 51/2638* (2013.01)

(58) Field of Classification Search
CPC ..... B21D 51/2638; B21D 51/2615; B21D 51/2692; B21D 37/10; B21D 37/12; B21D 37/14; B21D 43/14
USPC ..... 72/349
See application file for complete search history.

(56) References Cited

U.S. PATENT DOCUMENTS

| | | | | |
|---|---|---|---|---|
| 5,676,006 | A * | 10/1997 | Marshall | B21D 51/26 72/94 |
| 7,418,852 | B2 * | 9/2008 | Schill | B21D 51/2692 72/94 |
| 9,308,570 | B2 * | 4/2016 | Dunwoody | B21D 51/2638 |
| 2007/0144304 | A1 * | 6/2007 | El Hachem | F16H 53/06 74/838 |
| 2007/0227859 | A1 * | 10/2007 | Marshall | B21D 51/2692 198/618 |

* cited by examiner

*Primary Examiner* — Christopher L Templeton
*Assistant Examiner* — Teresa A Guthrie
(74) *Attorney, Agent, or Firm* — OLIFF PLC.

(57) ABSTRACT

A multi-station neck forming equipment for ring-pull cans includes at least two necking stations, each including: a main shaft turret assembly, drive shaft turret assembly, tailstock support assembly and frame assembly. The main shaft turret assembly includes a main turret shaft, mold turret assembly, push plate turret assembly, and main shaft turret planetary gear, and the mold turret assembly is composed of a group of several mold end sleeve assemblies, which include a mold end sleeve, mold end push rod, necking external mold, necking internal mold and two mold end follower bearings, and the bearings adopt the drive structure of elastically clamping the mold end cam.

10 Claims, 7 Drawing Sheets

MULTI-STATION NECK FORMING EQUIPMENT FOR RING-PULL CANS

TECHNICAL FIELD

The present invention relates to an equipment for forming can openings of metal cans, in particular to a multi-station neck forming equipment for ring-pull cans. The so-called neck forming mainly refers to the necking machining of a can opening, and also the subsequent processes such as expanded flanging, curling or flaring, etc on the basis of necking machining process.

BACKGROUND OF INVENTION

With the improvement of people's living standards, ring-pull cans are used more and more in the field of food and beverage, especially in beer and beverage packaging. The ring-pull can is composed of a can body and an easy open lid. In order to reduce the weight of the easy open lid, reduce the cost of the easy open lid, and facilitate packing and transportation, the necking process is used for the can bodies currently available in the market. Furthermore, in order to provide a can body with a lid, the flanging process may be required on the basis of necking; and the flaring and curling processes are required for the bottle can.

A multi-station neck forming equipment is required for the neck forming of ring-pull cans, and it includes the multi-mold extrusion processes to gradually reduce the diameter of can opening until the finally required neck size is achieved. For example, the diameter of the can opening with a diameter of 211 mm is changed to 209 mm, 206 mm, 202 mm or 200 mm; The diameter of the can opening with a diameter of 204 mm is changed to 202 mm or 200 mm. Besides necking station, the neck forming equipment can also include flanging station, can bottom forming station, optical inspection station, etc.

In the prior art, an invention patent of the U.S. Pat. No. 9,308,570B2 with the title of High Speed Necking Configuration was announced and authorized on Apr. 12, 2016. This patent is about a horizontal can necking machine, which includes a plurality of main turrets and a plurality of driving planetary gears. Each main turret includes a main turret shaft, a main gear installed on the main turret shaft, a propeller assembly, and a mold capable of necking the can body when the turret shaft is started. Each driving planetary gear includes a drive shaft and a drive gear mounted on the drive shaft. The main gear engages with the transfer case so that the centerlines of the main gear and the relative transfer case form an included angle of less than 170 degrees, thereby increasing the angle range available for necking the can body. The main turret and driving planetary gear can be operated to the neck, moving at least 2,800 cans every minute, and the stroke length of each propeller assembly relative to the mold is at least 1.5 inches.

The above-mentioned U.S. patent provides a scheme for necking the opening of ring-pull cans under high-speed operating conditions. However, due to the high operating speed, it is inevitable that the cans will be crushed, damaged, dropped and jammed during the transfer and handover between stations.

In view of this, the subject of the present invention is how to improve the existing technology to improve the stability and reliability of the neck forming equipment for ring-pull cans under high-speed operating conditions.

DISCLOSURE OF THE INVENTION

The present invention provides a multi-station neck forming equipment for ring-pull cans, which aims to solve the problem of stability and reliability of the operation of the neck forming equipment for ring-pull cans under high-speed operating conditions.

In order to achieve the above objectives, the technical scheme adopted by the present invention is: a multi-station neck forming equipment for ring-pull cans, comprises at least two necking stations, each of which comprising a main shaft turret assembly, a drive shaft turret assembly, a tailstock support assembly and a frame assembly for supporting the main shaft turret assembly, the drive shaft turret assembly and the tailstock support assembly.

Each main shaft turret assembly includes a main turret shaft, a mold turret assembly, a push plate turret assembly, and a main shaft turret planetary gear located between the mold turret assembly and the push plate turret assembly, wherein:

The mold turret assembly is composed of a group of several mold end sleeve assemblies, which are evenly spaced around the main turret shaft in the circumferential direction and positioned relative to the main turret shaft.

The push plate turret assembly is composed of a group of several push plate end push rod assemblies, which are evenly spaced around the main turret shaft in the circumferential direction and positioned relative to the main turret shaft.

The number of the group of several mold end sleeve assemblies is the same as that of the group of several push plate end push rod assemblies, one group of several mold end sleeve assemblies is located at one end of the main turret shaft in the longitudinal direction, one group of several push plate end push rod assemblies is located at the other end of the main turret shaft in the longitudinal direction, and the positions of the group of several mold end sleeve assemblies correlate with the positions of the group of several push plate end push rod assemblies in the circumferential direction of the main turret shaft.

The innovation lies in that the mold end sleeve assembly comprises a mold end sleeve, a mold end push rod, a necking external mold, a necking internal mold and two mold end follower bearings, wherein:

The mold end sleeve is fixedly positioned relative to the main turret shaft, and the mold end sleeve is provided with an inner cylinder surface for slide-and-guide.

The mold end push rod is of a rod structure, which is inserted into the inner cylinder surface of the mold end sleeve and is axially slidably fitted relative to the inner cylinder surface of the mold end sleeve.

The necking external mold is fixed on the head of the mold end sleeve for working, the necking internal mold is fixed on the head of the mold end push rod for working, the necking internal mold is located in the necking external mold and able to slide relative to the necking external mold following the sliding of the mold end push rod.

The mold end follower bearing is of a rolling bearing structure, and two mold end follower bearings are rotationally positioned at the tail of the mold end push rod. The rotation axes of the two mold end follower bearings are perpendicular to the axis of the mold end push rod. The two mold end follower bearings are arranged at intervals in the axial direction of the tail of the mold end push rod to clamp the mold end cam that drives the mold end push rod to slide, wherein: one mold end follower bearing is fixedly positioned and connected with the mold end push rod, and the other mold end follower bearing is elastically positioned relative to the mold end push rod in the direction of clamping the mold end cam.

The above described technical solution is explained as follows:

1. In above described technical solution, the mold end sleeve assembly comprises a mold end preloaded spring, a mold end bolt and a mold end slider. The mold end slider is provided with a through-hole, and the mold end bolt is inserted into the through-hole of the mold end slider and fixed at the tail of the mold end push rod, so that the mold end slider is slidably connected at the tail of the mold end push rod along the axis direction of the mold end push rod, and the mold end preloaded spring is inserted on the mold end bolt. One end of the mold end preloaded spring acts on the mold end bolt and the other end acts on the mold end slider, forcing the mold end slider to abut against the mold end push rod. The other mold end follower bearing is positioned and installed on the mold end slider, so that the other mold end follower bearing is elastically positioned relative to the mold end push rod in the direction of clamping the mold end cam.
2. In above described technical solution, the push plate end push rod assembly has two structural forms: the first is a linear guide type push plate end push rod assembly, and the second is a sleeve type push plate end push rod assembly. Wherein:

The first linear guide type push plate end push rod assembly comprises a linear push plate end slide rail, a push plate end push rod, a push plate and two push plate end follower bearings, wherein:

The linear push plate end slide rail is composed of a slide rail and a slide carriage. The slide rail is fixed and positioned relative to the main turret shaft, and the slide carriage is matched with the slide rail.

The push plate end push rod is of a rod structure which is fixed on the slide carriage.

The push plate is a part for necking the can opening of ring-pull can in cooperation with the necking external mold and the necking internal mold. The push plate is fixed on the head of the push plate end push rod for working.

The push plate end follower bearing is of a rolling bearing structure, and two push plate end follower bearings are rotationally positioned at the tail of the push plate end push rod. The rotation axes of the two push plate end follower bearings are perpendicular to the axis of the push plate end push rod. The two push plate end follower bearings are arranged at intervals in the axial direction of the tail of the push plate end push rod to clamp the push plate end cam that drives the push plate end push rod to slide, wherein: one push plate end follower bearing is fixedly positioned and connected with the push plate end push rod, and the other push plate end follower bearing is elastically positioned relative to the push plate end push rod in the direction of clamping the push plate end cam.

The second sleeve type push plate end push rod assembly comprises a push plate end sleeve, a push plate end push rod, a push plate and two push plate end follower bearings, wherein:

The push plate end sleeve is fixedly positioned relative to the main turret shaft, and the push plate end sleeve is provided with an inner cylinder surface for slide-and-guide.

The push plate end push rod is of a rod structure, which is inserted into the inner cylinder surface of the push plate end sleeve and is axially slidably fitted relative to the inner cylinder surface of the push plate end sleeve.

The push plate is a part for necking the can opening of ring-pull can in cooperation with the necking external mold and the necking internal mold. The push plate is fixed on the head of the push plate end push rod for working.

The push plate end follower bearing is of a rolling bearing structure, and two push plate end follower bearings are rotationally positioned at the tail of the push plate end push rod. The rotation axes of the two push plate end follower bearings are perpendicular to the axis of the push plate end push rod. The two push plate end follower bearings are arranged at intervals in the axial direction of the tail of the push plate end push rod to clamp the push plate end cam that drives the push plate end push rod to slide, wherein: one push plate end follower bearing is fixedly positioned and connected with the push plate end push rod, and the other push plate end follower bearing is elastically positioned relative to the push plate end push rod in the direction of clamping the push plate end cam.

3. In above described technical solution, the drive shaft turret assembly comprises a drive turret shaft, and the included angle formed by the centerlines of the main turret shaft and two drive turret shafts of adjacent stations is less than or equal to 180 degrees. And the included angle formed by the centerlines of the main turret shaft and two drive turret shafts of adjacent stations can be designed to be less than or equal to 180 degrees, and greater than or equal to 170 degrees at the same time.
4. In above described technical solution, the extending stroke (travel stroke) of the mold end cam is 0.917 inches. The extending stroke (travel stroke) of the push plate end cam is at least 1.75 inches.

The design principle and idea of the present invention is: in order to solve the problem of stability and reliability of the operation of the neck forming equipment under high-speed operating conditions, the utility model mainly adopts the following improvement measures: First, in order to improve the operation accuracy of the neck forming equipment, the mold end sleeve assembly is improved. Specifically, the mold end sleeve assembly includes a mold end sleeve, a mold end push rod, a necking external mold, a necking internal mold and two mold end follower bearings. In particular, the design of the two mold end follower bearings constitutes a driving structure for elastically clamping the mold end cam, which can ensure the transmission of high-precision necking movement under high-speed operating conditions. Second, in order to improve the operation accuracy of the neck forming equipment, the push plate end push rod assembly can also be improved. Specifically, the following two structural forms can be adopted: the first is the linear guide type push plate end push rod assembly, and the second is the sleeve type push plate end push rod assembly. Wherein: the linear guide type push plate end push rod assembly comprises a linear push plate end slide rail, a push plate end push rod, a push plate and two push plate end follower bearings. The sleeve type push plate end push rod assembly comprises a push plate end sleeve, a push plate end push rod, a push plate and two push plate end follower bearings. Both the linear guide type push plate end push rod assembly and the sleeve type push plate end push rod assembly adopt two push plate end follower bearings to elastically clamp the push plate end cam, so as to improve the driving structure's transmission of high-precision necking movement under high-speed operating conditions. Since the necking movement can be realized by the design of the mold end cam and the push plate end cam, it can be seen that the mold end sleeve assembly and the push plate end push rod assembly of the present invention can achieve good stability, high reliability and high-quality necking effect under high-speed operating conditions.

Figure 1:
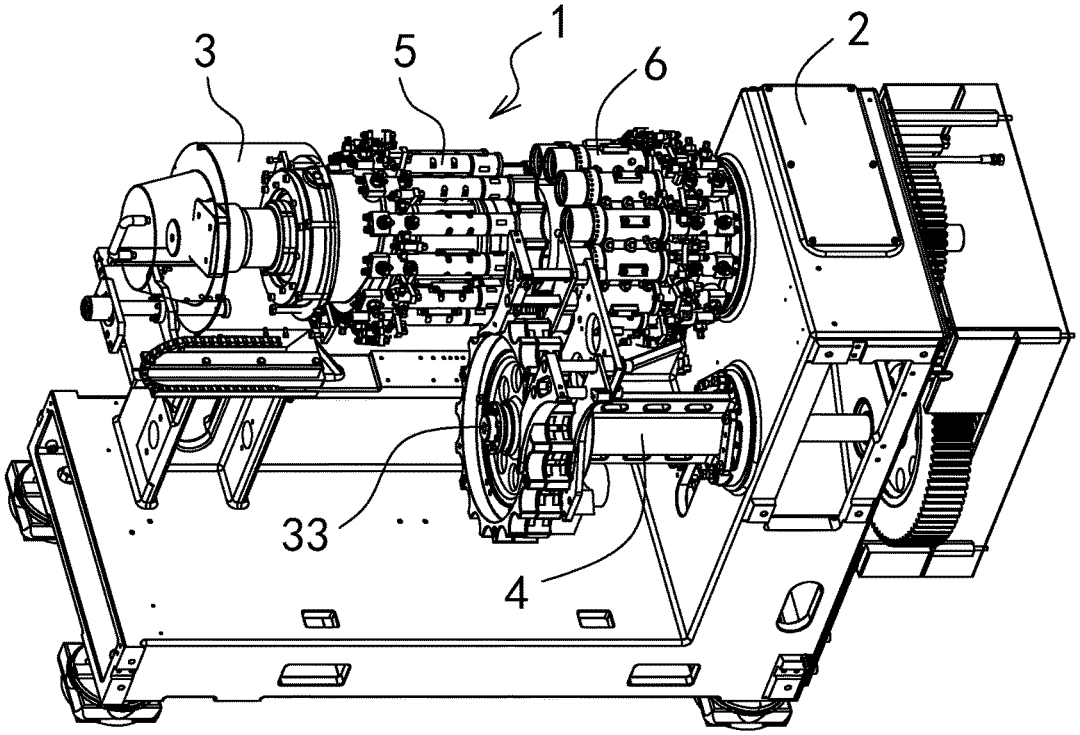
FIG. 1 shows the perspective view of a necking station according to an embodiment of the present invention.
Figure 2:
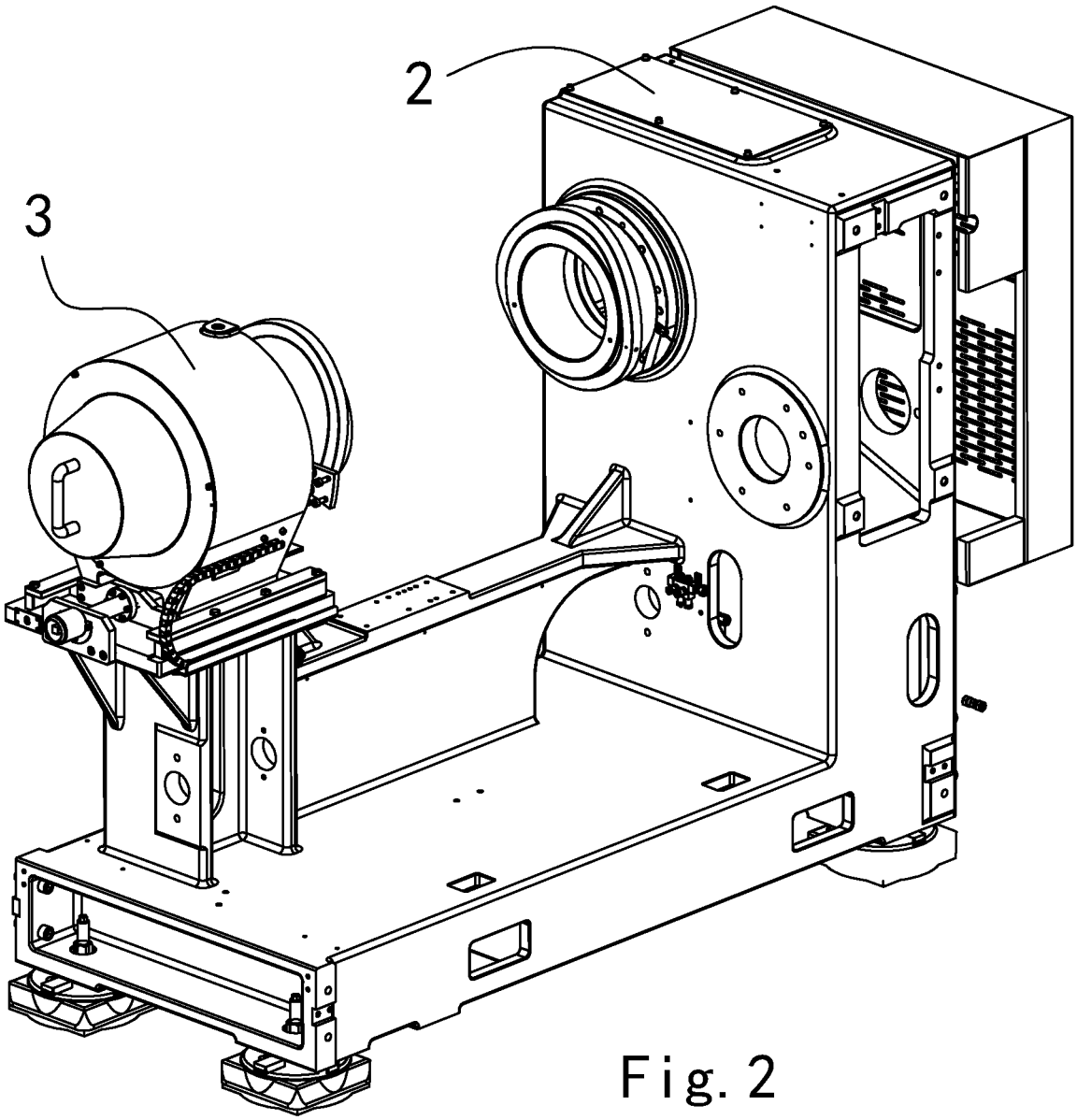
FIG. 2 is a perspective view of a frame assembly and a tailstock support assembly according to an embodiment of the present invention.

In the above figures: 1. Main shaft turret assembly; 2. Frame assembly; 3. Tailstock support assembly; 4. Drive shaft turret assembly; 5. Push rod assembly at the push plate end; 6. Mold end sleeve assembly; 7. Mold end follower bearing; 8. Necking external mold; 9. Necking internal mold; 10. Mold end sleeve; 11. Mold end push rod; 12. Air supply quick connector; 13. Mold end lubrication connector; 14. Mold end preloaded spring; 15. Lubrication connector in the sleeve; 16. Push plate; 17. Push plate end push rod; 18. Push plate end preloaded spring; 19. Push plate end linear slide guide; 20. Push plate end sleeve; 21. Main shaft turret planetary gear; 22. Push plate end follower bearing; 23. Push plate end lubrication connector; 24. Push plate end bolt; 25. Bushing; 26. Pressing plate; 27. Mold turret assembly; 28. Push plate turret assembly; 29. Main turret shaft; 30. Mold end bolt; 31. Mold end slider; 32. Push plate end slider; 33. Drive turret shaft.

SPECIFIC EMBODIMENT

With reference to the accompanying drawings and embodiment, the present invention will be described in detail.

Embodiment 1: A multi-station neck forming equipment for ring-pull cans (a combination of a mold end sleeve assembly and a linear guide type push plate end push rod assembly). As shown in FIG. 1-9, the multi-station neck forming equipment is composed of a necking station, a flanging station, a can bottom forming station, and an optical inspection station, etc. And the necking station is composed of three necking stations. Each necking station (see FIG. 1) includes a main shaft turret assembly 1, a drive shaft turret assembly 4 (see FIG. 1), a tailstock support assembly 3 (see FIG. 2), and a frame assembly 2 (see FIG. 2) for supporting the main shaft turret assembly 1, the drive shaft turret assembly 4, and the tailstock support assembly 3. Each drive shaft turret assembly 4 is provided with a main shaft turret planetary gear 21 for transferring cans, and the main shaft turret planetary gear 21 is provided with a vacuum suction tank for sucking cans.

Figure 3:
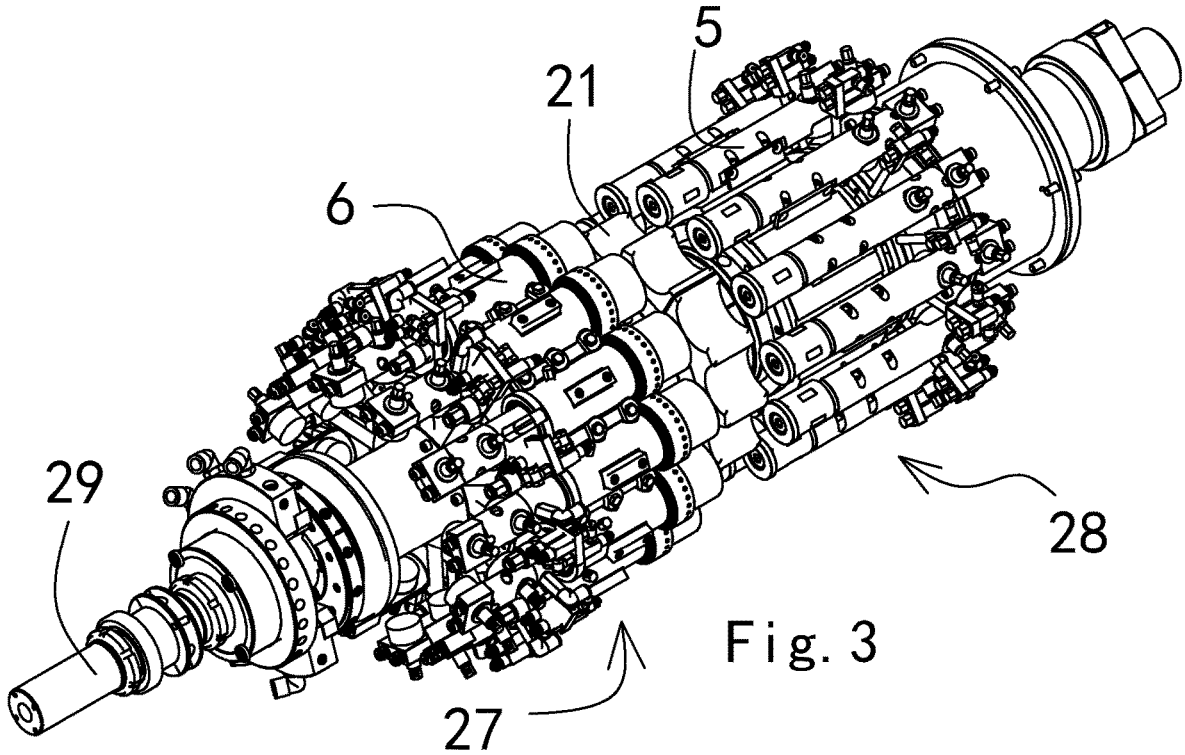
FIG. 3 is a perspective view of the main shaft turret assembly according to an embodiment of the present invention.
Figure 4:
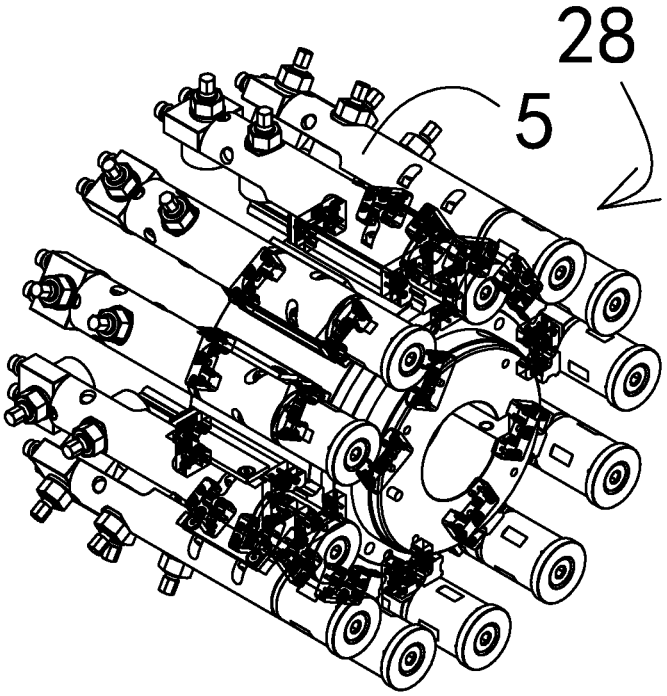
FIG. 4 is a perspective view of the push plate turret assembly according to an embodiment of the present invention.
Figure 5:
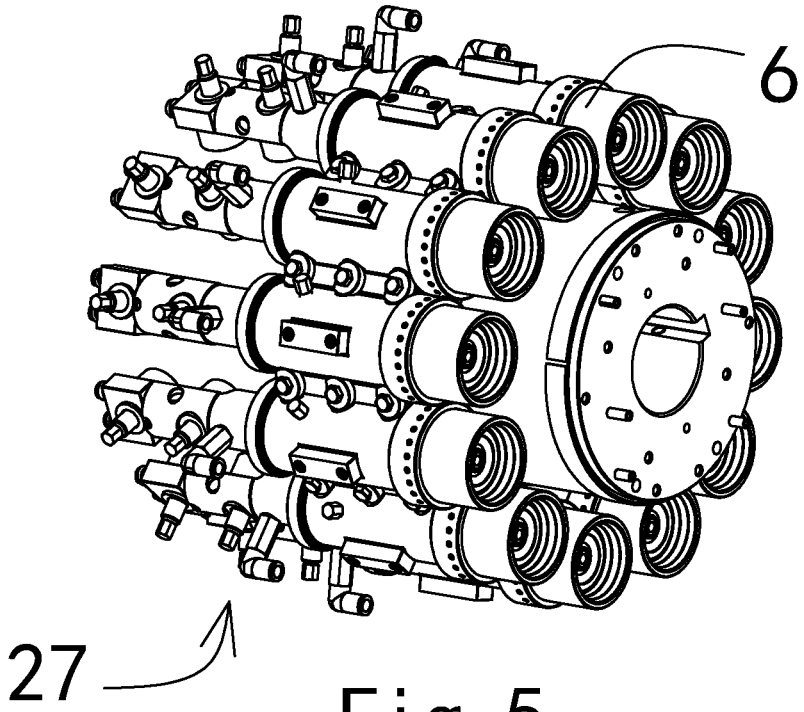
FIG. 5 is a perspective view of the mold turret assembly according to an embodiment of the present invention.

Each main shaft turret assembly 1 includes a main turret shaft 29, a mold turret assembly 27, a push plate turret assembly 28, and a main shaft turret planetary gear 21 located between the mold turret assembly 27 and the push plate turret assembly 28 (see FIG. 3), wherein:

The mold turret assembly 27 is composed of a group of 12 mold end sleeve assemblies 6 (see FIG. 5), and the group of 12 mold end sleeve assemblies 6 are evenly spaced around the main turret shaft 29 in the circumferential direction and positioned relative to the main turret shaft 29 (see FIG. 3).

The push plate turret assembly 28 is composed of a group of 12 push plate end push rod assemblies 5 (see FIG. 4), and the group of 12 push plate end push rod assemblies 5 are evenly spaced around the main turret shaft 29 in the circumferential direction and positioned relative to the main turret shaft 29 (see FIG. 3).

The number of the group of 12 mold end sleeve assemblies 6 is the same as that of the group of 12 push plate end push rod assemblies 5, one group of 12 mold end sleeve assemblies 6 is located at one end of the main turret shaft 29 in the longitudinal direction, one group of several push plate end push rod assemblies 5 is located at the other end of the main turret shaft 29 in the longitudinal direction (see FIG. 3), and the positions of the group of 12 mold end sleeve assemblies 6 correlate with the positions of the group of 12 push plate end push rod assemblies 5 in the circumferential direction of the main turret shaft 29 (see FIG. 3).

The mold end sleeve assembly 6 (see FIG. 6) comprises a mold end sleeve 10, a mold end push rod 11, a necking external mold 8, a necking internal mold 9 and two mold end follower bearings 7, wherein:

The mold end sleeve 10 (see FIG. 6) is fixedly positioned relative to the main turret shaft 29, and the mold end sleeve 10 is provided with an inner cylinder surface for slide-and-guide. For the mold end sleeve 10, it is necessary to solve the problem of oil lubrication in the sleeve, because there is a high-speed linear relative movement between the mold end sleeve 10 and the mold end push rod 11. The part directly contacting the mold end push rod 11 may not be the inner cylindrical surface of the mold end sleeve 10, but may be an insert in the sleeve part, such as a self-lubricating bearing. The oil injection and lubrication in the mold end sleeve 10 can be realized automatically by an oil injector or manually by installing an oil nozzle. Automatic oil injection is generally realized by Lincoln™ lubricating oil pump. In order to solve the problem of the mold end sleeve 10, the mold end sleeve 10 is provided with a lubrication connector in the sleeve 15 in this embodiment to improve the lubrication of the mold end sleeve 10 and the mold end push rod 11.

The mold end push rod 11 (see FIG. 6) is of a rod structure, which is inserted into the inner cylinder surface of the mold end sleeve 10 and is axially slidably fitted relative to the inner cylinder surface of the mold end sleeve 10. The mold end push rod 11 is also provided with an air supply quick connector 12 (see FIG. 6).

The necking external mold 8 (see FIG. 6) is fixed on the head of the mold end sleeve 10 for working, the necking internal mold 9 (see FIG. 6) is fixed on the head of the mold end push rod 11 for working, the necking internal mold 9 is located in the necking external mold 8 and can slide relative to the necking external mold 8 following the sliding of the mold end push rod 11.

Figure 6:
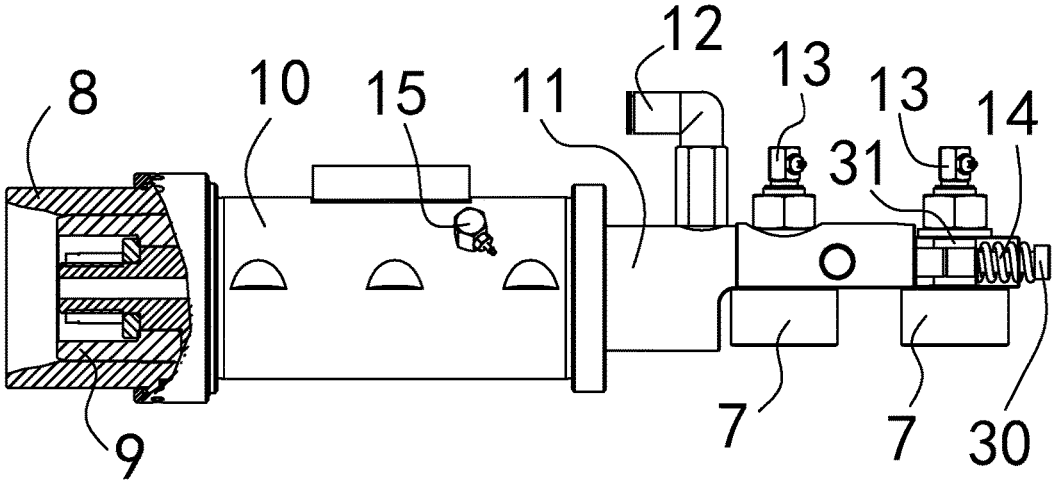
FIG. 6 is a front view of the mold end sleeve assembly according to an embodiment of the present invention.
Figure 7:
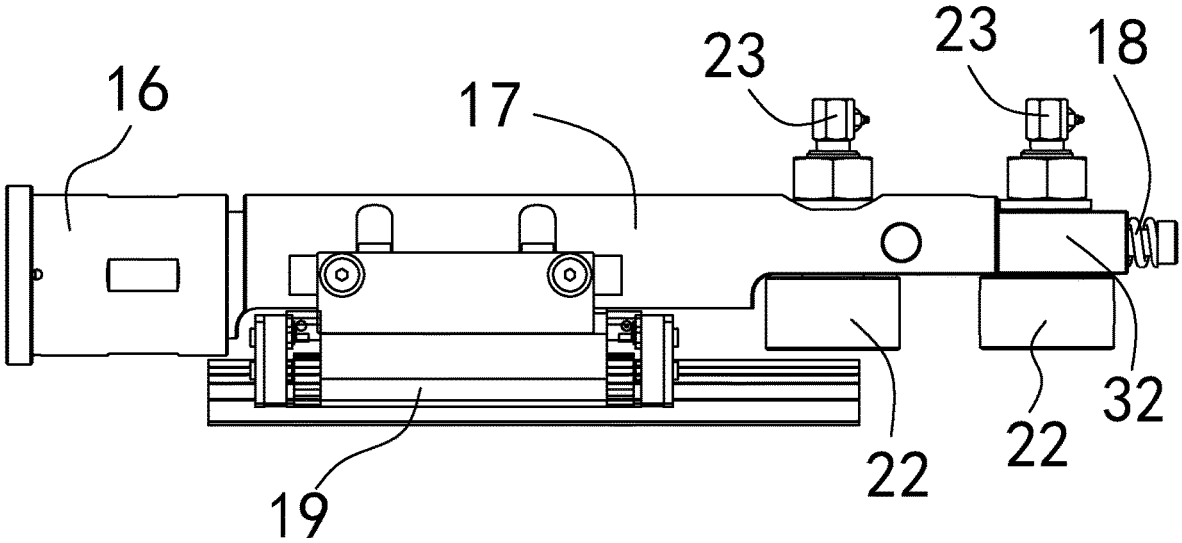
FIG. 7 is a front view of the linear guide type push plate end push rod assembly according to an embodiment of the present invention.

The mold end follower bearing 7 is of a rolling bearing structure, and two mold end follower bearings 7 are rotationally positioned at the tail of the mold end push rod 11 (see FIG. 6). The rotation axes of the two mold end follower bearings 7 are perpendicular to the axis of the mold end push rod 11. The two mold end follower bearings 7 are arranged at intervals in the axial direction of the tail of the mold end push rod 11 to clamp the mold end cam that drives the mold end push rod 11 to slide, wherein: one mold end follower bearing 7 is fixedly positioned and connected with the mold end push rod 11, and the other mold end follower bearing 7 is elastically positioned relative to the mold end push rod 11 in the direction of clamping the mold end cam.

The mold end sleeve assembly 6 (see FIG. 6) comprises a mold end preloaded spring 14, a mold end bolt 30 and a mold end slider 31. The mold end slider 31 is provided with a through-hole, and the mold end bolt 30 is inserted into the through-hole of the mold end slider 31 and fixed at the tail of the mold end push rod 11, so that the mold end slider 31 is slidably connected at the tail of the mold end push rod 11 along the axis direction of the mold end push rod 11, and the mold end preloaded spring 14 is inserted on the mold end bolt 30. One end of the mold end preloaded spring 14 acts on the mold end bolt 30 and the other end acts on the mold end slider 31, forcing the mold end slider 31 to abut against the mold end push rod 11. The other mold end follower bearing 7 is positioned and installed on the mold end slider 31, so that the other mold end follower bearing 7 is elastically positioned relative to the mold end push rod 11 in the direction of clamping the mold end cam (see FIG. 6).

The two mold end follower bearings 7 (see FIG. 6) are also provided with mold end lubrication connectors 13 to improve the lubrication between the mold end follower bearings 7 and the mold end cams.

The push plate end push rod assembly 5 adopts a linear guide type push plate end push rod assembly (see FIG. 7-9), which comprises a linear push plate end slide rail 19, a push plate end push rod 17, a push plate 16 and two push plate end follower bearings 22, wherein:

The linear push plate end slide rail 19 (see FIG. 7) is composed of a slide rail and a slide carriage. The slide rail is fixed and positioned relative to the main turret shaft 29, and the slide carriage is matched with the slide rail. The slide carriage is mounted on the slide rail through the pressing plate 26 (see FIG. 8). The linear slide rail can generally be maintained by oil injection during annual maintenance.

The push plate end push rod 17 (see FIG. 7) is of a rod structure which is fixed on the slide carriage.

The push plate 16 (see FIG. 7) is a part for necking the can opening of ring-pull can in cooperation with the necking external mold 8 and the necking internal mold 9. The push plate 16 is fixed on the head of the push plate end push rod 17 for working. In actual work, the push plate end push rod 17 carries the push plate 16 and is driven by the push plate end cam to realize the cooperation with the mold end cam of the internal mold 9. The push plate 16 and the inner mold 9 reciprocate linearly with a certain timing relationship to complete the process of pushing the can body into the mold for necking.

The push plate end follower bearing 22 is of a rolling bearing structure, and two push plate end follower bearings 22 are rotationally positioned at the tail of the push plate end push rod 17. The rotation axes of the two push plate end follower bearings 22 are perpendicular to the axis of the push plate end push rod 17. The two push plate end follower bearing 22 are arranged at intervals in the axial direction of the tail of the push plate end push rod 17 to clamp the push plate end cam that drives the push plate end push rod 17 to slide, wherein: one push plate end follower bearing 22 is fixedly positioned and connected with the push plate end push rod 17, and the other push plate end follower bearing 22 is elastically positioned relative to the push plate end push rod 17 in the direction of clamping the push plate end cam.

The push plate end sleeve assembly 5 (see FIG. 8) comprises a push plate end preloaded spring 18, a push plate end bolt 24 and a push plate end slider 32. The push plate end slider 32 is provided with a through-hole, and the push plate end bolt 24 is inserted into the through-hole of the push plate end slider 32 and fixed at the tail of the push plate end push rod 17, so that the push plate end slider 32 is slidably connected at the tail of the push plate end push rod 17 along the axis direction of the push plate end push rod 17, and the push plate end preloaded spring 18 is inserted on the push plate end bolt 24. One end of the push plate end preloaded spring 18 acts on the push plate end bolt 24 and the other end acts on the push plate end slider 32, forcing the push plate end slider 32 to abut against the push plate end push rod 17. The other push plate end follower bearing 22 is positioned and installed on the push plate end slider 32, so that the other push plate end follower bearing 22 is elastically positioned relative to the push plate end push rod 17 in the direction of clamping the push plate end cam.

The push plate end cam is fixed on the tailstock support assembly 3. The tailstock support assembly 3, the main shaft turret assembly 1 and the drive shaft turret assembly 4 are all positioned and supported on a frame assembly 2. In the working state, the mold end sleeve assembly 6 and the push plate end push rod assembly 5 are located at both ends of the can body. The can opening faces the mold end sleeve assembly 6, and the can bottom faces the push plate end push rod assembly 5.

Figure 8:
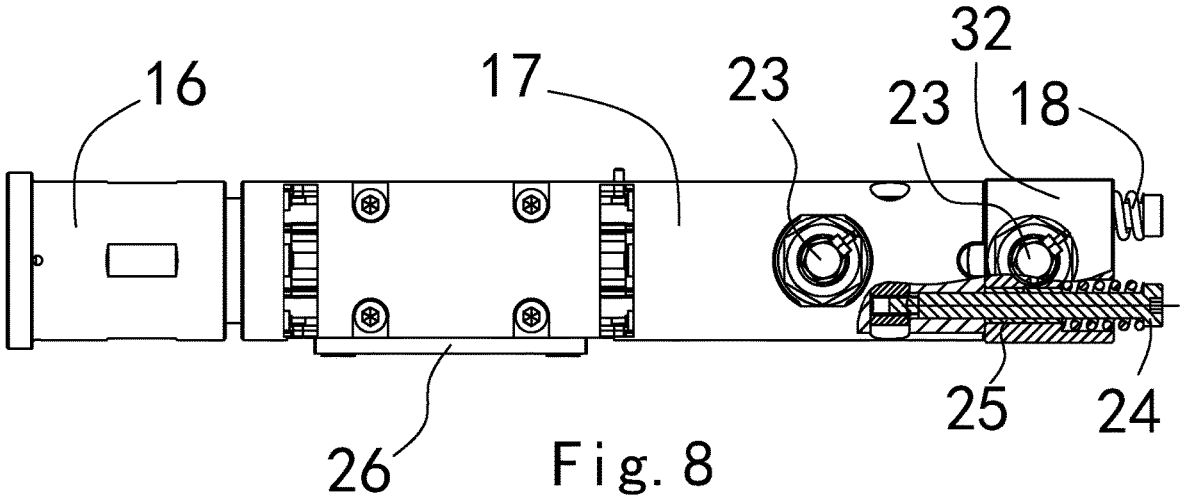
FIG. 8 is a top view of FIG. 7.
Figure 9:
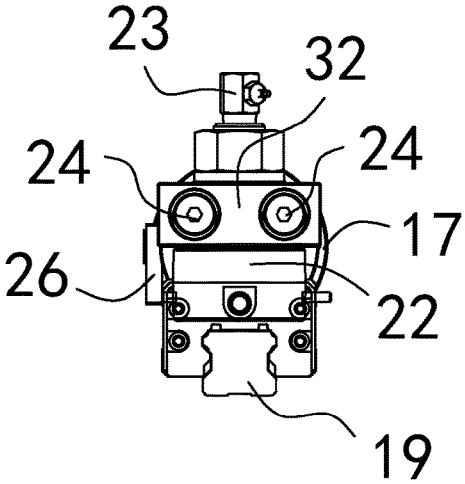
FIG. 9 is a right side view of FIG. 7.

In order to improve the sliding fit precision between the push plate end slider 32 and the push plate end bolt 24, a bushing 25 is provided between the push plate end bolt 24 and the push plate end slider 32 (see FIG. 8). The bushing 25 is fixed in the through hole of the push plate end slider 32, and the push plate end bolt 24 is slidably fitted with the bushing 25.

The two push plate end follower bearings 22 (see FIG. 7) are also provided with push plate end lubrication connectors 23 to improve the lubrication between the push plate end follower bearings 22 and the push plate end cams.

The drive shaft turret assembly 4 comprises a drive turret shaft 33, and the included angle formed by the centerlines of the main turret shaft 29 and two drive turret shafts 33 of adjacent stations is less than or equal to 180 degrees. In the embodiment, the included angle formed by the centerlines of the main turret shaft and two drive turret shafts of adjacent stations is less than or equal to 180 degrees, and greater than or equal to 170 degrees at the same time. The extending stroke (travel stroke) of the mold end cam is 0.917 inches. The extending stroke (travel stroke) of the push plate end cam is at least 1.75 inches. According to the existing can type and production demand, the extending stroke can be designed as 1.875 inches.

In the actual can neck forming, the distance between the push plate 16 and the end face of the necking external mold 8 is related to the can shape and the mold design. This value can be preliminarily calculated according to the requirements of the necking external mold and the can shape drawing. In order to meet the production requirements applicable to a variety of can shapes, the mold turret assembly 27 and the push plate turret assembly 28 shall be of one end that can move axially on the main turret shaft 29. Generally, the mold end turret 27 is fixed, that is, the necking external mold 8 is fixed, and the push plate end turret assembly 28 is adjustable on the main turret shaft 29. In the process of neck forming, the can body needs to be filled with compressed air through the air supply quick connector 12 to ensure the strength of the can body during forming and the smooth withdrawal from the mold after necking. Therefore, each necking station is equipped with a air distribution assembly to provide compressed air.

Embodiment 2: A multi-station neck forming equipment for ring-pull cans (a combination of a mold end sleeve assembly and a sleeve type push plate end push rod assembly).

The multi-station neck forming equipment is composed of a necking station, a flanging station, a can bottom forming station, and an optical inspection station, etc. And the necking station is composed of three necking stations. And the necking station is composed of three necking stations. Each necking station (see FIG. 1) includes a main shaft turret assembly 1, a drive shaft turret assembly 4 (see FIG. 1), a tailstock support assembly 3 (see FIG. 2), and a frame assembly 2 (see FIG. 2) for supporting the main shaft turret assembly 1, the drive shaft turret assembly 4, and the tailstock support assembly 3 (see FIG. 2).

The difference between the embodiment 2 and embodiment 1 is: the linear guide type push plate end push rod assembly in embodiment 1 is replaced by the sleeve type push plate end push rod assembly in embodiment 2.

Figure 10:
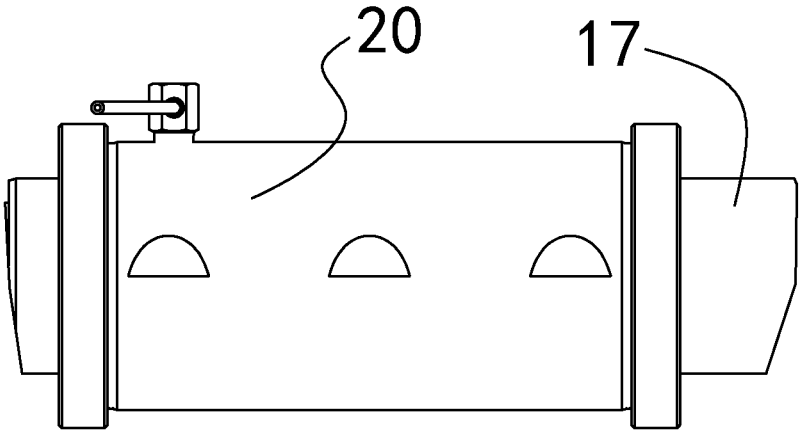
FIG. 10 is a general view of the sleeve type push plate end push rod assembly according to an embodiment of the present invention.

As shown in FIG. 10, the push plate end push rod assembly 5 adopts a sleeve type push plate end push rod assembly, which comprises a push plate end sleeve 20, a push plate end push rod 17, a push plate 16 and two push plate end follower bearings 22, wherein:

The push plate end sleeve 20 (see FIG. 10) is fixedly positioned relative to the main turret shaft 29, and the push plate end sleeve 20 is provided with an inner cylinder surface for slide-and-guide.

The push plate end push rod 17 (see FIG. 10) is of a rod structure, which is inserted into the inner cylinder surface of the push plate end sleeve 20 and is axially slidably fitted relative to the inner cylinder surface of the push plate end sleeve 20.

The push plate 16 (see FIG. 7) is a part for necking the can opening of ring-pull can in cooperation with the necking external mold 8 and the necking internal mold 9. The push plate 16 is fixed on the head of the push plate end push rod 17 for working.

The push plate end follower bearing 22 is of a rolling bearing structure, and two push plate end follower bearings 22 (see FIG. 7) are rotationally positioned at the tail of the push plate end push rod 17. The rotation axes of the two push plate end follower bearings 22 are perpendicular to the axis of the push plate end push rod 17. The two push plate end follower bearing 22 are arranged at intervals in the axial direction of the tail of the push plate end push rod 17 to clamp the push plate end cam that drives the push plate end push rod 17 to slide, wherein: one push plate end follower bearing 22 is fixedly positioned and connected with the push plate end push rod 17, and the other push plate end follower bearing 22 is elastically positioned relative to the push plate end push rod 17 in the direction of clamping the push plate end cam.

The sleeve assembly at push plate end 5 comprises a push plate end preloaded spring 18, a push plate end bolt 24 and a push plate end slider 32. The push plate end slider 32 is provided with a through-hole, and the push plate end bolt 24 is inserted into the through-hole of the push plate end slider 32 and fixed at the tail of the push plate end push rod 17, so that the push plate end slider 32 is slidably connected at the tail of the push plate end push rod 17 along the axis direction of the push plate end push rod 17, and the push plate end preloaded spring 18 is inserted on the push plate end bolt 24. One end of the push plate end preloaded spring 18 acts on the push plate end bolt 24 and the other end acts on the push plate end slider 32, forcing the push plate end slider 32 to abut against the push plate end push rod 17. The other push plate end follower bearing 22 is positioned and installed on the push plate end slider 32, so that the other push plate end follower bearing 22 is elastically positioned relative to the push plate end push rod 17 in the direction of clamping the push plate end cam.

The other contents are the same as those in the embodiment 1 and are not described repeatedly.

The following the description about the other embodiments and structural variations of the present invention:

1. In the embodiment 1, the necking station is composed of three necking stations. However, the present invention is not limited to this, and it may be composed of two necking stations, four necking stations, five necking stations, or even more. Theoretically it's composed of at least two necking stations. It depends on the can size and necking requirements, which can be understood and known by those skilled in the art.
2. In the embodiment 1, the mold turret assembly 27 is composed of a group of 12 mold end sleeve assemblies 6 (see FIG. 5). However, the present invention is not limited to this and the number of mold end sleeve assemblies 6 in the mold turret assembly 27 can be increased or decreased from 12, which is determined according to specific conditions. Similarly, the push plate turret assembly 28 is composed of a group of 12 push plate end push rod assemblies 5 (see FIG. 4), which is also the same and can be understood and accepted by those skilled in the art.
3. In the embodiment 1, the mold end follower bearing 7 is lubricated with oil through the mold end lubrication connector 13, and the push plate end follower bearing 22 is lubricated with oil through the push plate end lubrication connector 23. However, the present invention is not limited to this, and a follower bearing free of lubrication may be used.
4. In the embodiment 1, the necking external mold 8, the necking internal mold 9 and the push plate 16 are all realized by using the prior art.

It should be noted that the above described embodiments are only for illustration of technical concept and characteristics of present invention with purpose of making those skilled in the art understand the present invention, and thus these embodiments shall not limit the protection range of present invention. The equivalent changes or modifications according to spiritual essence of present invention shall fall in the protection scope of present invention.

What is claimed is:

1. A multi-station neck forming equipment for ring-pull cans comprising:

at least two necking stations, each further comprising a main shaft turret assembly, a drive shaft turret assembly, a tailstock support assembly and a frame assembly for supporting the main shaft turret assembly, the drive shaft turret assembly and the tailstock support assembly, wherein each main shaft turret assembly includes a main turret shaft, a mold turret assembly, a push plate turret assembly, and a main shaft turret planetary gear located between the mold turret assembly and the push plate turret assembly, the mold turret assembly is composed of a group of mold end sleeve assemblies, which are evenly spaced around the main turret shaft in a circumferential direction and positioned relative to the main turret shaft, the push plate turret assembly is composed of a group of push plate end push rod assemblies, which are evenly spaced around the main turret shaft in the circumferential direction and positioned relative to the main turret shaft, a number of the group of mold end sleeve assemblies is the same as that of the group of push plate end push rod assemblies, the group of mold end sleeve assemblies is located at one end of the main turret shaft in a longitudinal direction, the group of push plate end push rod assemblies is located at the other end of the main turret shaft in the longitudinal direction, and the positions of the group of mold end sleeve assemblies correlate with the positions of the group of push plate end push rod assemblies in the circumferential direction of the main turret shaft, the mold end sleeve assembly comprises a mold end sleeve, a mold end push rod, a necking external mold, a necking internal mold and two mold end follower bearings, the mold end sleeve is fixedly positioned relative to the main turret shaft, and the mold end sleeve is provided with an inner cylinder surface for slide-and-guide, the mold end push rod is of a rod structure, which is inserted into the inner cylinder surface of the mold end sleeve and is axially slidably fitted relative to the inner cylinder surface of the mold end sleeve, the necking external mold is fixed on a head of the mold end sleeve for working, the necking internal mold is fixed on a head of the mold end push rod for working, the necking internal mold is located in the necking external mold and able to slide relative to the necking external mold following the sliding of the mold end push rod, one of the mold end follower bearing is of a rolling bearing structure, and the two mold end follower bearings are rotationally positioned at a tail of the mold end push rod; rotation axes of the two mold end follower bearings are perpendicular to an axis of the mold end push rod; the two mold end follower bearings are arranged at intervals in an axial direction of the tail of the mold end push rod to clamp a mold end cam that drives the mold end push rod to slide, wherein: one mold end follower bearing is fixedly positioned and connected with the mold end push rod, and the other mold end follower bearing is elastically positioned relative to the mold end push rod in a direction of clamping the mold end cam, thereby constituting a driving structure for elastically clamping the mold end cam, the group of push plate end push rod assemblies comprises a linear guide type push plate end push rod assembly or a sleeve type push plate end rod assembly, each including a push plate end push rod, a push plate, and two push plate end follower bearings configured to clamp a push plate end cam with one push plate end follower bearing fixed and the other push plate end follower bearing elastically positioned, thereby forming a driving structure for elastically clamping the push plate end cam, a push plate end sleeve assembly comprises a push plate end slider and a push plate end bolt, and a bushing is disposed between the push plate end bolt and the push plate end slider, the bushing is fixed in a through hole of the push plate end slider, and the push plate end bolt is slidably fitted with the bushing.

2. The multi-station neck forming equipment for ring-pull cans according to claim 1, wherein: the mold end sleeve assembly comprises a mold end preloaded spring, a mold end bolt and a mold end slider; the mold end slider is provided with a through-hole, and the mold end bolt is inserted into the through-hole of the mold end slider and fixed at the tail of the mold end push rod, so that the mold end slider is slidably connected at the tail of the mold end push rod along an axis direction of the mold end push rod, and the mold end preloaded spring is inserted on the mold end bolt; one end of the mold end preloaded spring acts on the mold end bolt and the other end acts on the mold end slider, forcing the mold end slider to abut against the mold end push rod; the other mold end follower bearing is positioned and installed on the mold end slider, so that the other mold end follower bearing is elastically positioned relative to the mold end push rod in the direction of clamping the mold end cam.

3. The multi-station neck forming equipment for ring-pull cans according to claim 2, wherein: an extending stroke of the mold end cam is 0.917 inches.

4. The multi-station neck forming equipment for ring-pull cans according to claim 1, wherein: each of the push plate end push rod assemblies comprises a linear push plate end slide rail, wherein:

the linear push plate end slide rail is composed of a slide rail and a slide carriage; the slide rail is fixed and positioned relative to the main turret shaft, and the slide carriage is matched with the slide rail, the push plate end push rod is of a rod structure which is fixed on the slide carriage, the push plate is a part for necking a can opening of a ring-pull can in cooperation with the necking external mold and the necking internal mold; the push plate is fixed on the head of the push plate end push rod for working, and each of the push plate end follower bearings is of a rolling bearing structure, and the two push plate end follower bearings are rotationally positioned at a tail of the push plate end push rod; rotation axes of the two push plate end follower bearings are perpendicular to an axis of the push plate end push rod; and the two push plate end follower bearings are arranged at intervals in an axial direction of the tail of the push plate end push rod to clamp the push plate end cam that drives the push plate end push rod to slide.

5. The multi-station neck forming equipment for ring-pull cans according to claim 4, wherein: one of the push plate end push rod assemblies comprises a push plate end preloaded spring that is inserted on the push plate end bolt; one end of the push plate end preloaded spring acts on the push plate end bolt and the other end acts on the push plate end slider, forcing the push plate end slider to abut against the push plate end push rod; the other push plate end follower bearing is positioned and installed on the push plate end slider, so that the other push plate end follower bearing is elastically positioned relative to the push plate end push rod in a direction of clamping the push plate end cam.

6. The multi-station neck forming equipment for ring-pull cans according to claim 4, wherein: an extending stroke of the push plate end cam is at least 1.75 inches.

7. The multi-station neck forming equipment for ring-pull cans according to claim 1, wherein: the drive shaft turret assembly comprises a drive turret shaft, and an included angle formed by centerlines of the main turret shaft and two drive turret shafts of adjacent stations is less than or equal to 180 degrees.

8. The multi-station neck forming equipment for ring-pull cans according to claim 7, wherein: the included angle formed by the centerlines of the main turret shaft and the two drive turret shafts of adjacent stations is less than or equal to 180 degrees, and greater than or equal to 170 degrees at the same time.

9. The multi-station neck forming equipment for ring-pull cans according to claim 1, wherein: an extending stroke of the mold end cam is 0.917 inches.

10. The multi-station neck forming equipment for ring-pull cans according to claim 1, wherein: an extending stroke of the push plate end cam is at least 1.75 inches.

* * * * *